US005538339A

United States Patent [19]

Röck et al.

[11] Patent Number: 5,538,339

[45] Date of Patent: Jul. 23, 1996

[54] DRAWER CONSTRUCTION SET

[75] Inventors: Erich Röck, Höchst, Austria; Fredi Dubach, Adetswil, Switzerland

[73] Assignee: Julius Blum Gesellschaft m.b.H., Höchst, Austria

[21] Appl. No.: 360,787

[22] PCT Filed: Jun. 1, 1993

[86] PCT No.: PCT/AT93/00092

§ 371 Date: Dec. 30, 1994

§ 102(e) Date: Dec. 30, 1994

[87] PCT Pub. No.: WO94/01019

PCT Pub. Date: Jan. 20, 1994

[30] Foreign Application Priority Data

Jul. 2, 1992 [AT] Austria ..... 1351/92

[51] Int. Cl.[6] ..... A47B 88/00; A47B 88/04

[52] U.S. Cl. ..... 312/348.1; 312/348.2; 312/349; 312/330.1

[58] Field of Search ..... 312/348.1, 140, 312/330.1, 349, 348.2, 348.4, 334.27, 334.32

[56] References Cited

U.S. PATENT DOCUMENTS

| | | | |
|---|---|---|---|
| 1,352,002 | 9/1920 | Jones | 312/348.2 |
| 2,678,866 | 5/1954 | Merrett | 312/349 |
| 3,416,850 | 12/1968 | Hilfinger et al. . | |
| 3,511,550 | 5/1970 | Hilfinger et al. | 312/348.1 |
| 3,646,634 | 3/1972 | Fusselman | 312/330.1 X |
| 4,120,551 | 10/1978 | Godtschalck | 312/348.1 |
| 4,379,604 | 4/1983 | Röck et al. . | |
| 4,875,746 | 10/1989 | Rock et al. | 312/330.1 |
| 5,180,217 | 1/1993 | Lautensclager | 312/330.1 X |
| 5,348,386 | 9/1994 | Grass | 312/348.2 |

FOREIGN PATENT DOCUMENTS

| | | | |
|---|---|---|---|
| 323932 | 8/1975 | Austria . | |
| 243092 | 10/1987 | European Pat. Off. | 312/348.1 |
| 626144 | 11/1994 | European Pat. Off. | 312/330.1 |
| 2755527 | 6/1978 | Germany | 312/348.2 |
| 9016490.3 | 2/1991 | Germany . | |
| 1412723 | 7/1988 | U.S.S.R. | 312/348.1 |
| 1052919 | 12/1966 | United Kingdom | 312/330.1 |
| 1449319 | 9/1976 | United Kingdom . | |
| 2193430 | 2/1988 | United Kingdom . | |
| 2013473 | 8/1992 | WIPO | 312/349 |

*Primary Examiner*—Peter M. Cuomo
*Assistant Examiner*—Rodney B. White
*Attorney, Agent, or Firm*—Wenderoth, Lind & Ponack

[57] ABSTRACT

A drawer construction set includes two metal drawer frames, each having a rear end thereof a flange extending inwardly. The flange has an upwardly open slot and a lower slot. A metal drawer rear wall has at opposite ends thereof respective bent webs, each having an upper hook and a lower positioning lug. The hooks of the rear wall are fittable into the upwardly open upper slots of the drawer frames to suspend the rear wall therefrom. The positioning lugs of the rear wall then are fittable into the lower slots of the drawer frames, to prevent vertical displacement of the rear wall relative thereto.

17 Claims, 7 Drawing Sheets

DRAWER CONSTRUCTION SET

BACKGROUND OF THE INVENTION

The invention relates to a drawer construction set comprising two metal drawer frames, each of which is provided at a rear end thereof with an inwardly directed flange and each of which has a support web for a base plate, and a metal drawer rear wall provided with hooks which can be suspended in slots in the drawer frames.

With conventional drawer construction sets, the frames and the drawer rear wall have to be screwed to one another. This clearly is very time-consuming, especially in the case of production runs of very large numbers. Generally, the rear wall in such case is made from a wood material, for example a chipboard. Metal rear walls are used in particular for office furniture, for example for filing cabinets. Here too, the drawer frame is connected by screws or rivets. In many cases, no base plate is provided.

Furthermore, drawer construction sets are known in which the drawer frames and the rear wall can be connected without a tool, simply by pushing them together. Such construction sets enable assembly to be very rapid and simple. The individual components of construction sets of this type are, however, made from synthetic material in accordance with the known prior art. Examples of such construction sets can be found in GB-A-2 087 715 and GB-A-2 101 879. However, the strength and thus the loading capacity of drawers which have been produced using such construction sets is rather limited. Furthermore, separate pull-out guide rails are required to enable the drawer to run in a pull-out guide fitting.

SUMMARY OF THE INVENTION

It is the object of the invention to provide a drawer construction set of the type mentioned above, having metal drawer frames and whereby it is possible to connect the metal drawer frames to a rear wall rapidly, and whereby it is possible to connect such parts without a tool.

Such object is achieved according to the invention in that each drawer frame has a flange having therein an opening, such that the drawer rear wall can be anchored on the flanges, and in that the drawer rear wall has, in a manner known per se, positioning lugs which project into corresponding openings in the flanges and prevent vertical displacement of the drawer rear wall with respect to the drawer frames. Advantageously, the positioning lugs are constructed in the manner of webs and the openings are slot-shaped. Also, slots in which the hooks can be suspended are upwardly open in order to facilitate suspension of the rear wall on the drawer frames.

The hooks and the positioning lugs advantageously are constructed on rearwardly bent end or marginal webs or flanges of the rear wall. In such case, the rear all advantageously has an upper horizontal web, as a result of which a stable box-type profile is formed together with the marginal webs. In order to improve stability of the drawer, it is advantageously provided for the drawer rear wall to have, above a support web for the base plate, a groove-shaped profile in which the base plate is received without play, and for a vertical web of such profile to have a step. A further feature of the invention provides for the drawer rear wall to have at least one half-knob or protrusion below which fits the base plate. The base plate thus is held between the support web and the holding knob and is prevented from being raised away. Instead of a holding knob, a horizontal holding tab punched out of the drawer rear wall and advantageously projecting into a groove by the rear end of the base plate can be provided.

A further feature provides for the drawer rear wall to have outwardly projecting holding flanges for drawer rails, the width of the holding flanges being at least approximately the same as the width of the drawer frames. A construction set of this type enables a rail to be mounted without additional holding aids.

BRIEF DESCRIPTION OF THE DRAWINGS

Two embodiments of the invention will be described below in detail with reference to the accompanying drawings, wherein.

DETAILED DESCRIPTION OF THE INVENTION

Figure 8:
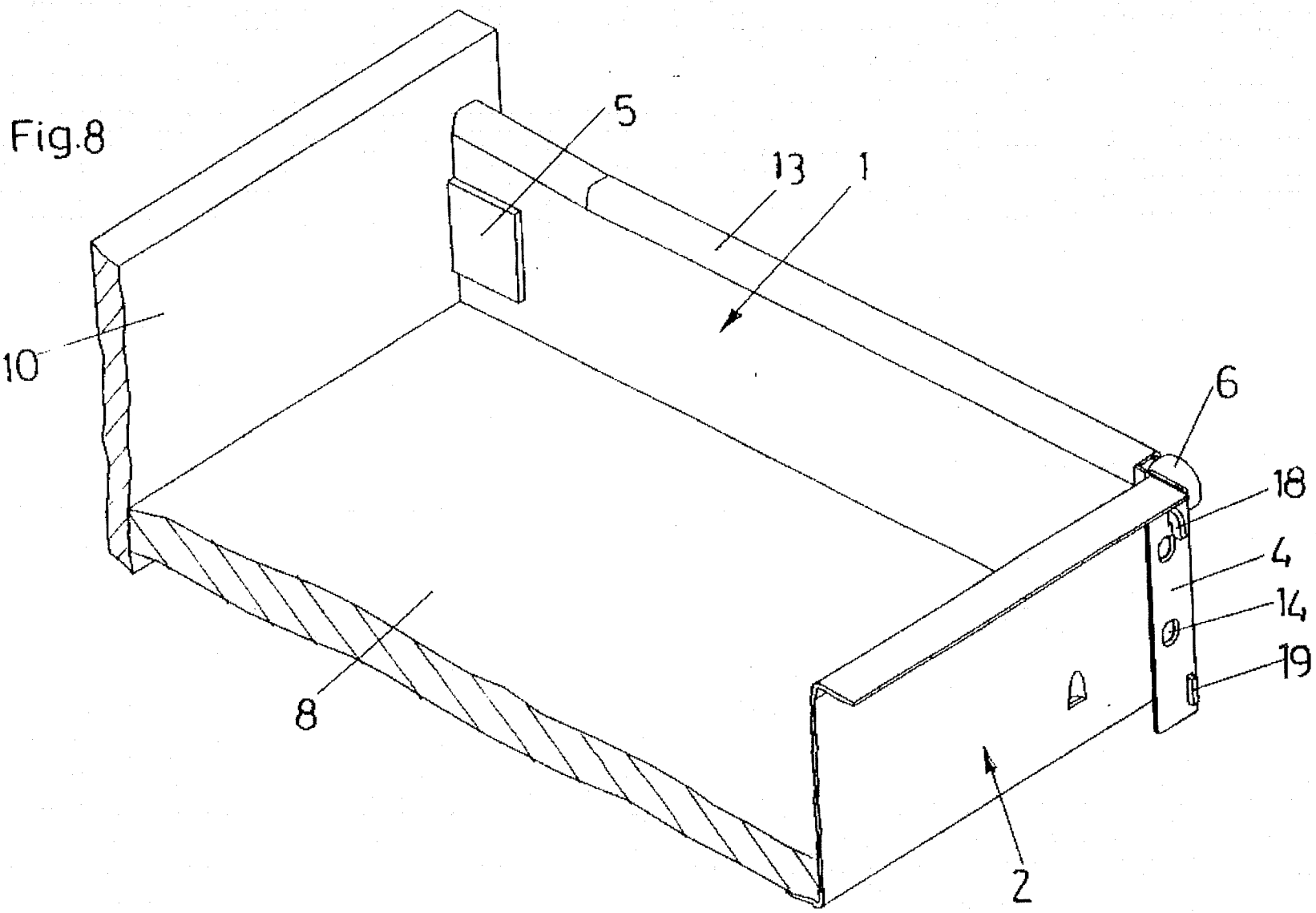
FIG. 8 is a perspective view of a drawer, one side thereof being shown in section.
Figure 9:
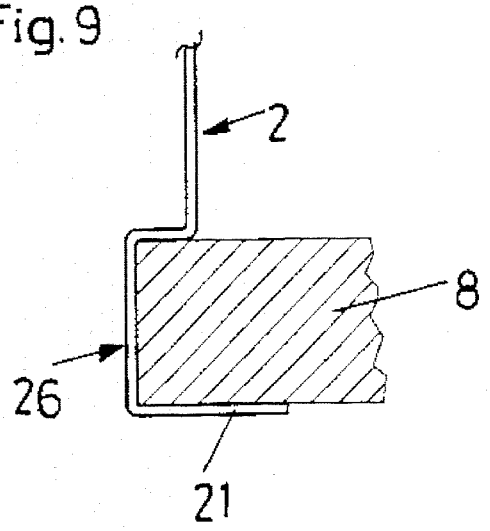
FIGS. 9 to 13 are partial sections of various profiles of the rear wall in the region of the base plate.
Figure 10:
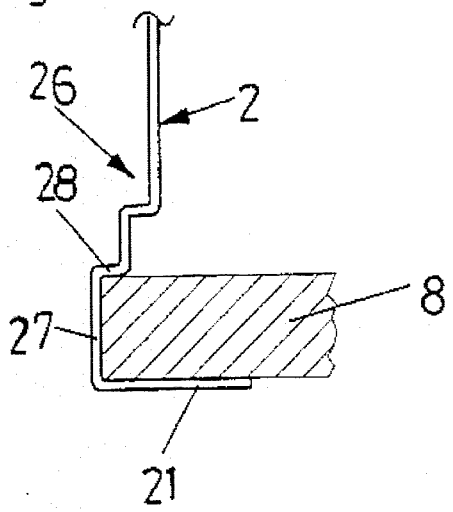
Figure 11:
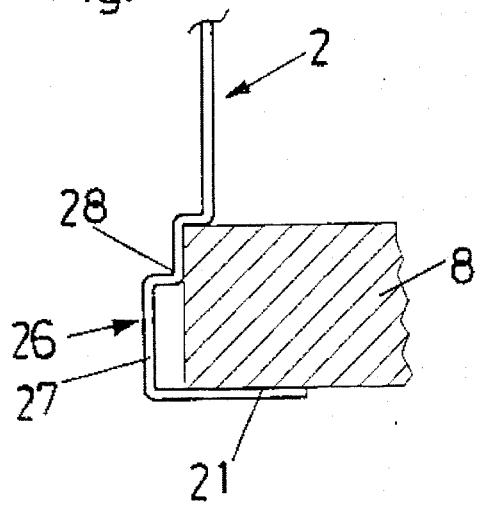
Figure 12:
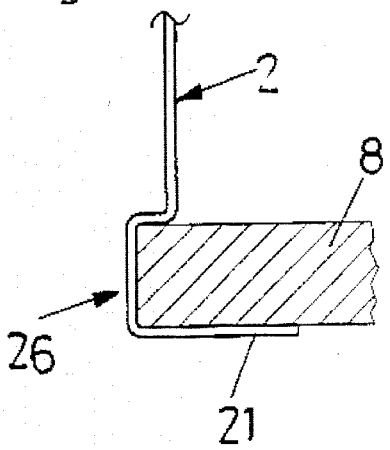
Figure 13:
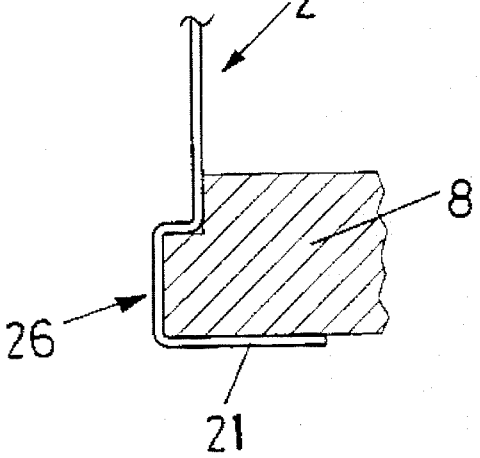

A drawer frame or side wall 1 has at a rear thereof a laterally inwardly bent flange 4 which serves to secure a drawer rear wall 2 or 3. At a front end thereof, the drawer frame 1 is provided with punched-out portions 9 which serve to secure a holding apparatus 5 of a drawer front panel 10 (FIG. 8). Furthermore, the drawer frame i has a support web 11 for a base plate 8. Punched out of the support web 11 are positioning tabs 12 which engage in corresponding holes in the base plate 8 and prevent the base plate 8 from being undesirably displaced. The drawer frame 1 furthermore has an upper horizontal web 13 which serves as a running web for a carcass-side running roller of a pull-out guide fitting or for running rollers of a running carriage. A running roller 6 is mounted on the drawer frame adjacent the flange 4 (FIG. 4).

The flange 4 has holes 14 which enable a conventional drawer rear wall, for example made from a wood material, to be screwed to the drawer frame 1. Furthermore, the flange 4 is provided with an upwardly open slot 15 and a lower closed slot 16 which serve to mount a drawer rear wall 2, 3 according to the invention.

The drawer rear wall 2, 3 has on each side thereof a marginal web 17 which is bent to extend rearwardly. Integrally formed on each marginal web 17 is an upper hook 18 and a lower web-shaped projection which serves as a positioning lug 19. Furthermore, the drawer rear wall 2, 3 has an upper horizontal web 20, a lower support web 21 for the base plate 8 and a punched-out holding knob or protrusion 22. In order to increase the rigidity of the drawer rear wall, the latter is provided directly above the support web 21 with a groove-like profile 26 into which the base plate 8 can be pushed (see FIGS. 9–13). A vertical web 27 of the profile 26 can have a step 28, so that base plates 8 of different thickness can be pushed into the profile 26.

Figure 4:
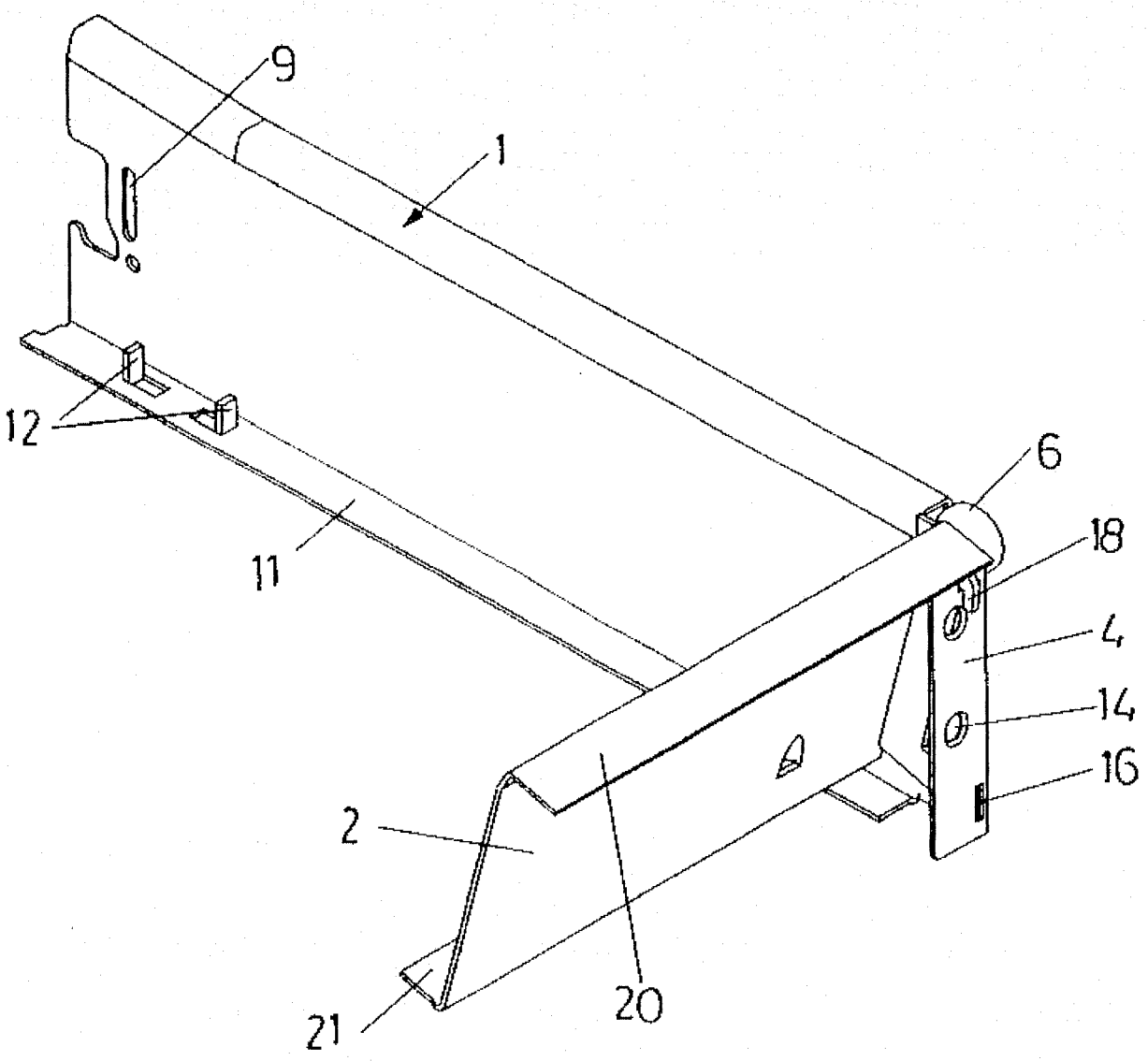
FIG. 4 is a perspective view of a drawer frame and a rear wall while the rear wall is being suspended.
Figure 5:
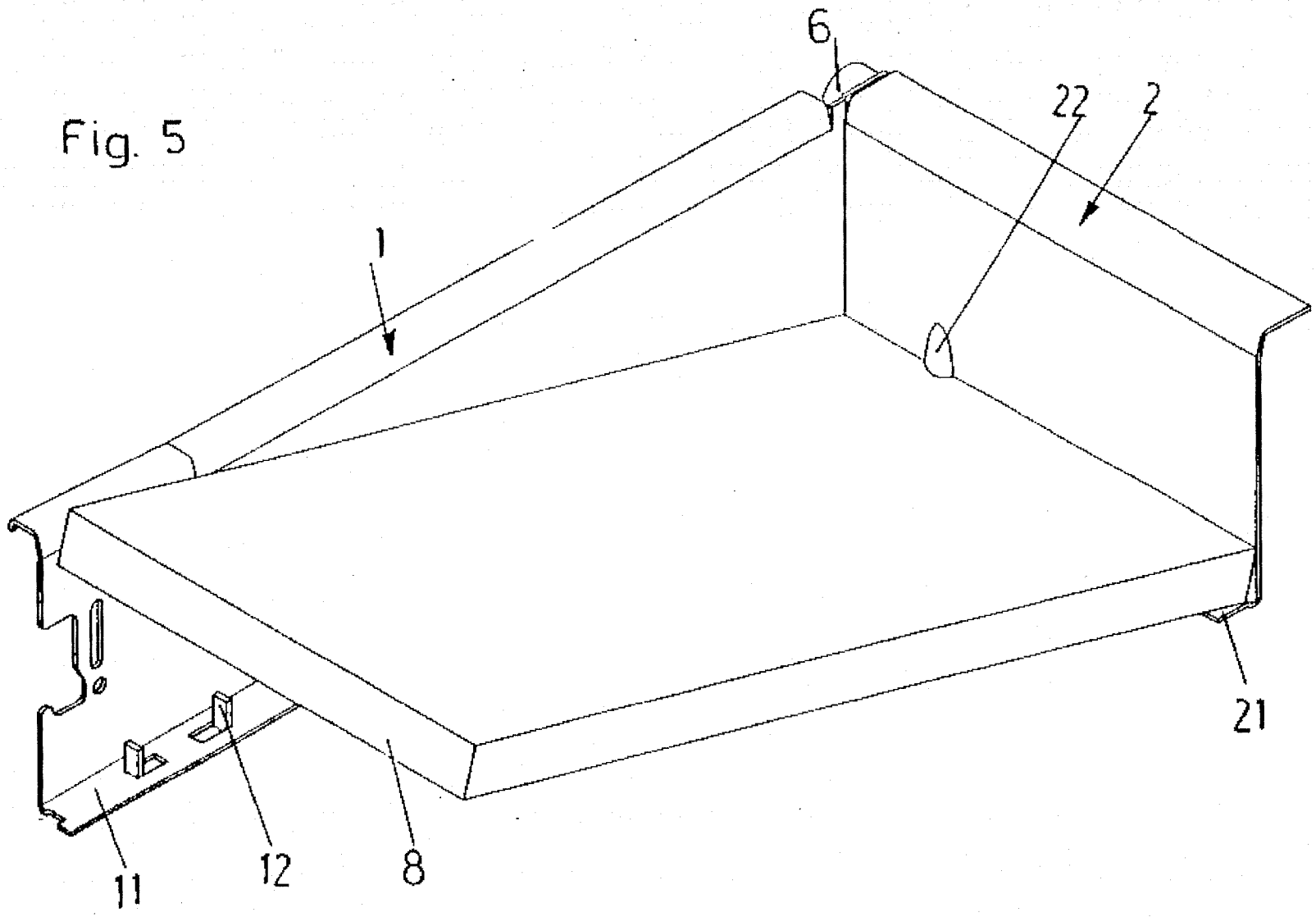
FIG. 5 is a perspective view of a drawer frame, a rear wall and a base plate while the base plate is being suspended.
Figure 6:
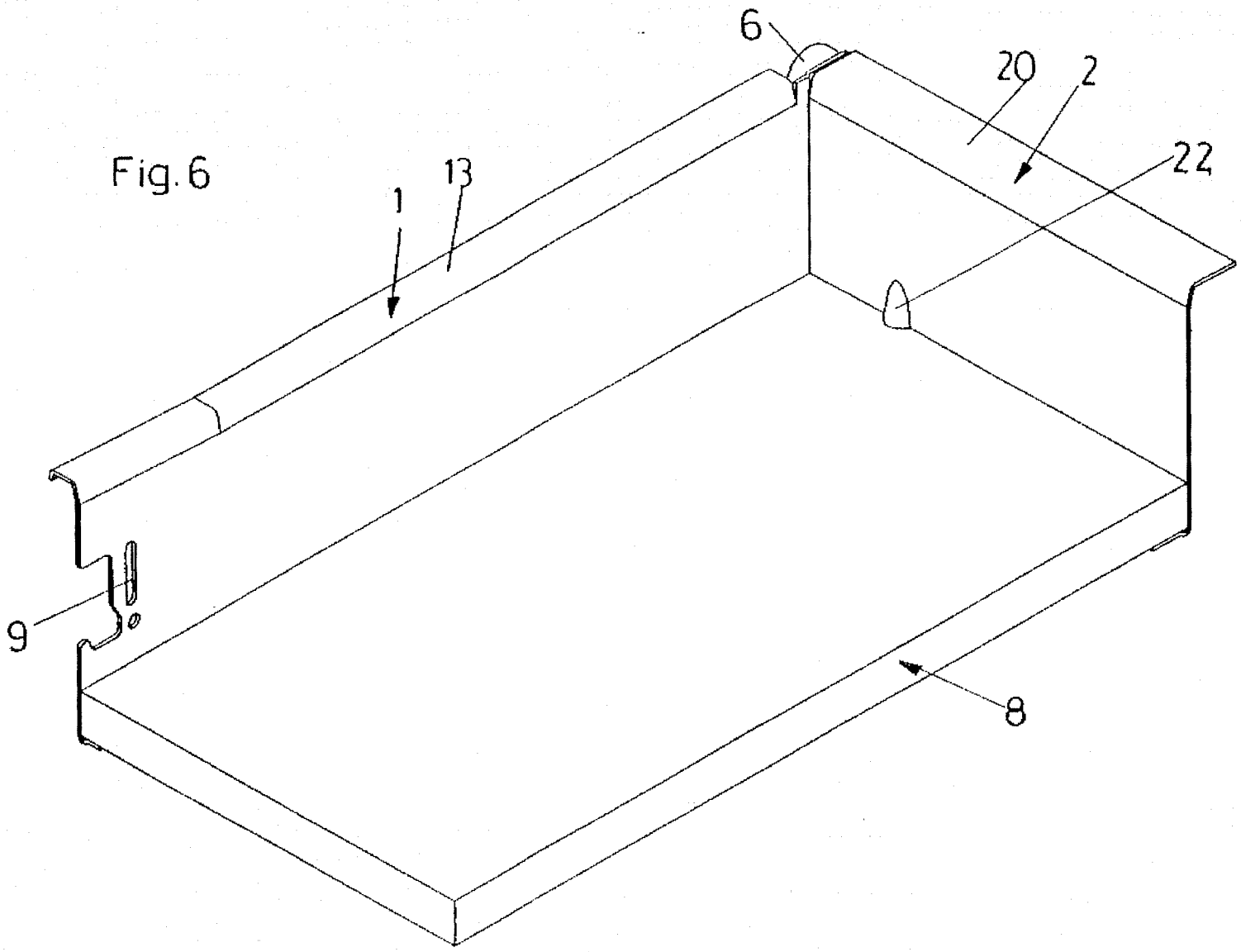
FIG. 6 is a perspective view of a mounted drawer construction set.

When the drawer construction set is assembled, first the drawer rear wall 2, 3 is suspended on drawer frame 1 by means of the hook 18 fitting in the slot 15, as shown in FIG. 4. The drawer rear wall then is pivoted until the web-shaped positioning lug 19 projects through the slot 16. Then, the base plate 8 is laid on the support webs 11, 21 and pushed under the holding knob 22. Finally, a front panel 10 is mounted in a conventional manner by means of the holding apparatus 5.

Figure 1:
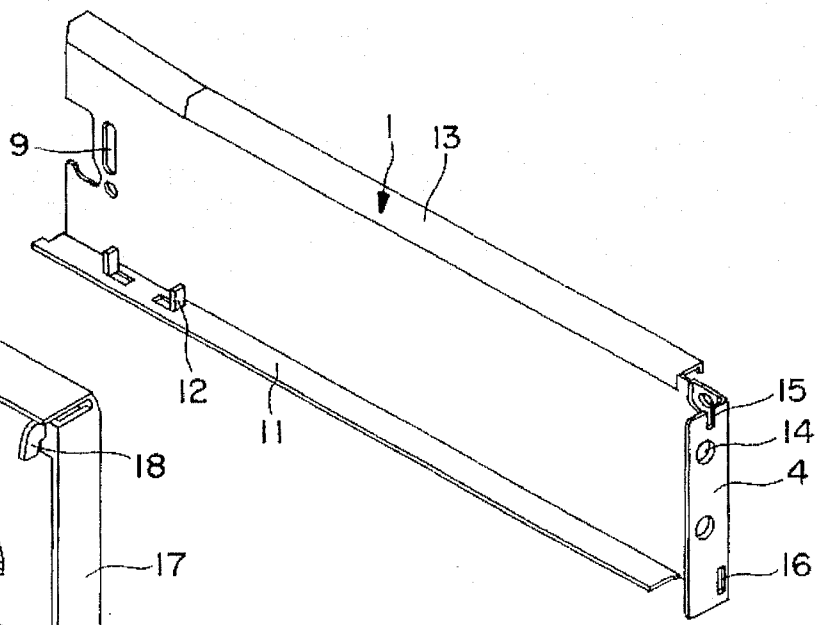
FIG. 1 is a perspective view of a drawer frame according to the invention.
Figure 2:
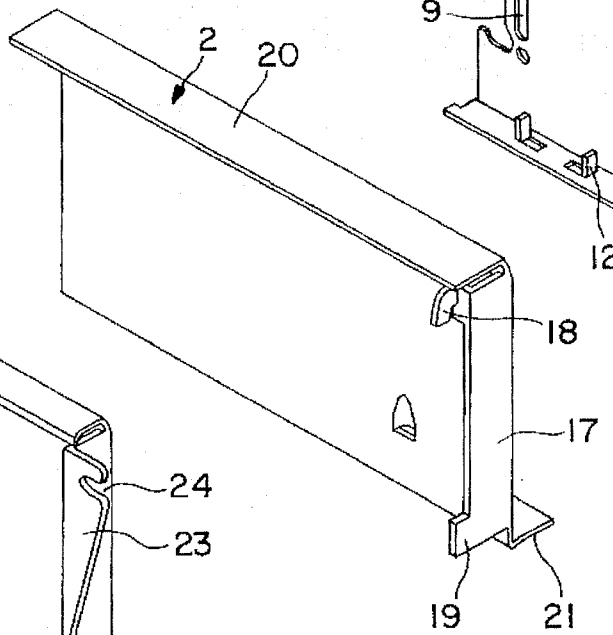
FIG. 2 is a perspective view of half of a rear wall according to the invention.
Figure 3:
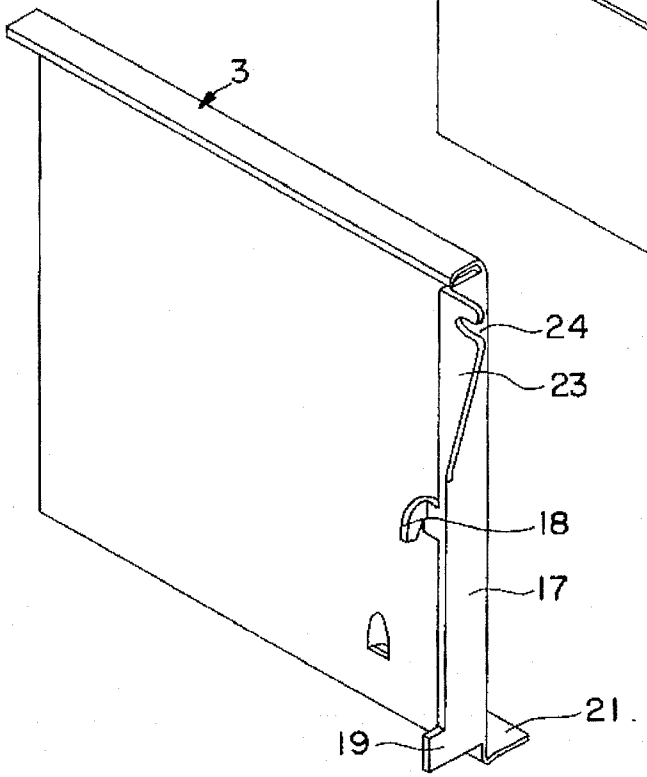
FIG. 3 is a perspective view of half of a rear wall according to a further embodiment of the invention.
Figure 7:
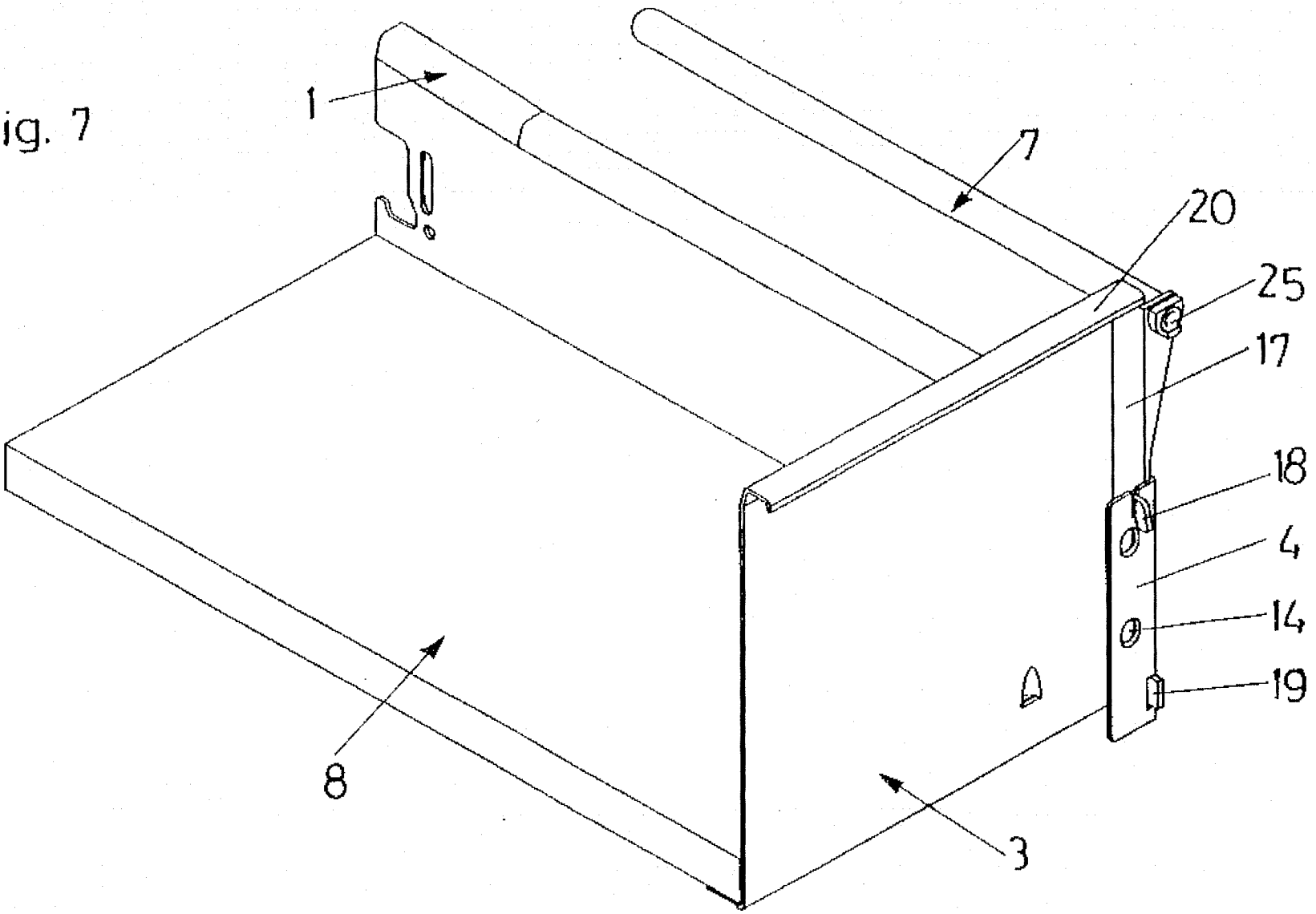
FIG. 7 is a perspective view of a mounted drawer construction set according to a further embodiment of the invention.

The drawer rear wall 3 according to the embodiment of FIG. 3 has lateral holding flanges 23 for a drawer rail 7 (FIG. 7). Each holding flange 23 has a laterally open slot 24, through which projects a screw 25 or the like for securing the rail 7. The opposite end of rail 7 is secured to the front panel 10 in a conventional manner. The width of the holding flanges 23 corresponds approximately to the width of the drawer frame 1, that is to say to the width of the horizontal web 13.

Instead of the holding knob 22, there can be punched out of the drawer rear wall 2, 3 a horizontal web which projects into a groove on a rear end of the base plate 8. This also prevents the base plate from being raised away.

We claim:

1. A drawer construction set to be employed to assembly a drawer, said drawer construction set comprising:

two metal drawer frames to be used to form sides of a drawer, each said drawer frame having at a rear end thereof a flange extending inwardly relative to the drawer when assembled, said flange having an upwardly open upper slot and a lower slot, and each said drawer frame having a support web for support of a base plate of the drawer;

a metal drawer rear wall having at opposite lateral ends thereof respective bent webs, each said web of said rear wall having an upper hook and a lower positioning lug; and said hooks of said rear wall being fittable into said upwardly open upper slots of said drawer frames, thereby to enable said rear wall to be suspended from said drawer frames, and said positioning lugs of said rear wall being fittable into said lower slots of said drawer frames, thereby to prevent vertical displacement of said rear wall relative to said drawer frames.

2. A drawer construction set as claimed in claim 1, wherein said bent webs at said opposite ends of said rear wall extend rearwardly thereof in directions transverse thereto.

3. A drawer construction set as claimed in claim 2, wherein said hook and said positioning lug of each said bent web extend rearwardly thereof.

4. A drawer construction set as claimed in claim 2, wherein said positioning lug of each said bent web extends coplanar therewith.

5. A drawer construction set as claimed in claim 1, wherein said positioning lug of each said bent web extends coplanar therewith.

6. A drawer construction set as claimed in claim 1, wherein said rear wall has at least one forwardly extending protrusion to fit over the base plate of the drawer.

7. A drawer construction set as claimed in claim 6, wherein said rear wall further has a forwardly extending support web positioned below said protrusion for support of the base plate of the drawer.

8. A drawer construction set as claimed in claim 7, wherein said rear wall has a groove-shaped profile located above said support web for receipt without play of a rear end of the base plate of the drawer.

9. A drawer construction set as claimed in claim 8, wherein said profile includes a vertical web having formed therein a step.

10. A drawer construction set as claimed in claim 1, wherein said rear wall has a forwardly extending support web for support of the base plate of the drawer.

11. A drawer construction set as claimed in claim 10, wherein said rear wall has a groove-shaped profile located above said support web for receipt without play of a rear end of the base plate of the drawer.

12. A drawer construction set as claimed in claim 11, wherein said profile includes a vertical web having formed therein a step.

13. A drawer construction set as claimed in claim 1, wherein said rear wall has, at each said end thereof an outwardly projecting holding flange for support of a drawer rail.

14. A drawer construction set as claimed in claim 13, wherein each said holding flange extends from the respective said bent web.

15. A drawer construction set as claimed in claim 14, wherein each said holding flange extends transversely of said respective bent web and parallel to said rear wall.

16. A drawer construction set as claimed in claim 13, wherein each said holding flange is positioned above the respective said hook.

17. A drawer construction set as claimed in claim 13, wherein each said holding flange has a width at least approximately the same as the width of the respective said drawer frame.

* * * * *